US007237353B1

(12) United States Patent
Beauchamp et al.

(10) Patent No.: US 7,237,353 B1
(45) Date of Patent: Jul. 3, 2007

(54) MUZZLE BREAK WITH GAS RELIEF MEMBRANE FOR AN UNDERWATER GUN

(75) Inventors: Charles H. Beauchamp, Jamestown, RI (US); Thomas J. Gieseke, Newport, RI (US); William H. Nedderman, Jr., Middletown, RI (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 150 days.

(21) Appl. No.: 10/911,753

(22) Filed: Jul. 30, 2004

(51) Int. Cl.
*F41A 21/46* (2006.01)
*F41F 3/10* (2006.01)

(52) U.S. Cl. ..... 42/1.14; 89/14.6

(58) Field of Classification Search ..... 89/5, 89/14.6, 1.809, 1.81; 42/1.14
See application file for complete search history.

(56) References Cited

U.S. PATENT DOCUMENTS 2,906,175 A * 9/1959 Mohaupt ..... 89/1.1
3,300,888 A * 1/1967 Belcher et al. ..... 42/1.14
3,455,047 A * 7/1969 Hoag ..... 42/96
3,677,132 A * 7/1972 Plenge ..... 89/14.2
5,245,905 A 9/1993 Bundy
5,639,982 A * 6/1997 Cipolla ..... 89/1.11
5,648,631 A * 7/1997 Kirschner et al. ..... 89/1.14
5,687,501 A * 11/1997 Stace et al. ..... 42/1.14
5,746,018 A 5/1998 Kirschner et al.
5,778,725 A * 7/1998 Kirschner et al. ..... 73/167
5,966,858 A 10/1999 Curtis et al.
6,339,992 B1 * 1/2002 Watson ..... 102/312
6,516,698 B1 2/2003 Poff
6,701,819 B1 * 3/2004 Williams et al. ..... 89/1.81
2004/0031381 A1 * 2/2004 Williams et al. ..... 89/1.809

* cited by examiner

*Primary Examiner*—Troy Chambers
(74) *Attorney, Agent, or Firm*—Michael P. Stanley; James M. Kasischke; Jean-Paul A. Nasser

(57) ABSTRACT

A muzzle break for a gun comprising a baffle, a series of slots in the housing of the muzzle break in which the slots exhaust gas of a pressure wave deflected by the baffle during firing of the gun. A membrane seals the slots for underwater use and is separable by the deflected exhaust gas. Another membrane seals a sabot separation chamber of the muzzle break adjacent to the baffle and in a projectile path from the baffle. The membrane for the separation chamber is detachable by a projectile fired from the gun.

7 Claims, 3 Drawing Sheets

MUZZLE BREAK WITH GAS RELIEF MEMBRANE FOR AN UNDERWATER GUN

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION (1) Field of the Invention

A baffled gun muzzle break capable of diverting exhaust gases of a fired underwater gun before sabot separation of a projectile.

(2) Description of the Prior Art

It is known in the art that underwater gun systems may be utilized as anti-mine and anti-torpedo devices. A basic underwater gun system includes underwater projectiles, an underwater gun, a ship-mounted turret, a targeting system, and a combat control system.

In operation of the underwater gun system, undersea targets (such as mines and torpedoes) are identified and localized with the targeting system. Based on signaling from the targeting system, the combat control system provides the commands to direct the ship-mounted turret to aim the underwater gun at the target. When directed, the underwater gun shoots the underwater projectiles in which the projectiles are specially designed for neutralization of undersea targets at a relatively long range (approximately 200 m).

In regard to the gun itself, guns with high muzzle velocities cannot be fired with water in their barrel. Firing a water-filled barrel results in very high breach pressures as the ignited propellant charge attempts to force the water out of the barrel. A likely result of high breach pressures is a material failure of the barrel.

In order to obtain the desired ranges, the projectile must travel through the water in a vapor cavity. A truncated cone is the optimum projectile shape to maximize the projectile mass that will maintain the vapor cavity. The truncated cone shape requires that the projectile be enclosed in a sabot within the barrel. Sabots are generally comprised of two or more petals in which the sabots have a cup on a leading edge in which the cup is designed to deflect and separate the petals from the projectile due to greater wind or other resistance on the petals relative to projectile as the round travels through the ambient gas medium.

For guns using sabots, a muzzle break must be mounted on the end of the barrel to allow the sabot to separate from the projectile. However, an exhaust gas pressure wave, occurring during firing from the ignited propellant charge, travels though the chamber at a rate equal to or greater than the round thereby inhibiting the sabot separation. For sabots fired into ambient air, this is generally not a problem since the exhaust gases are easily dissipated allowing the sabots to separate well. A problem occurs when rounds are fired into a confined muzzle break on the end of an underwater gun with the exhaust gas wave traveling though the sabot separation chamber at a rate equal to or greater than the round.

Since the exhaust gases cannot be readily dissipated, the fired round experiences a greatly reduced velocity through the gas and the sabot petals do not separate as quickly. As such, it is important that a significant quantity of the exhaust gases be diverted at the beginning of the sabot separation chamber to improve the separation process. However, the diversion of the exhaust gases must be done while still maintaining a water seal on the chamber prior to firing of the gun. As such, a muzzle break for the underwater gun must be designed to exhaust gases at the beginning of the separation stage while still maintaining a water seal on the chamber until the projectile exits the gun.

In Curtis et al. (U.S. Pat. No. 5,966,858), a baffled muzzle break and seal system for operation of a submerged gun is provided. Specifically, the cited reference provides baffle assembly within a gun chamber in which the baffle assembly deflects the propellant gasses produced by operation of the gun to an annular chamber. A pressurized air input prevents the entry of water when a water seal of the gun is opened to allow passage of a projectile. A valve gas exhaust provides a means for removing propellant gases from the chamber.

An improvement to the muzzle break of the cited reference as well as any other muzzles breaks for underwater guns that are known in the art would be a simpler constructed muzzle break with the ability to divert exhaust gases at the beginning of the separation stage of a sabot projectile while still maintaining a water seal on the separation chamber of the gun. Instead of reliance on a valve gas exhaust to remove exhaust gases and an increased size of the underwater gun when an annular chamber is part of the gun, a simpler muzzle break should be able divert exhaust gases immediately and efficiently while minimizing the complexity of the muzzle break.

SUMMARY OF THE INVENTION

Accordingly, it is an object of the present invention to provide a simple device for deflecting and releasing exhaust gases from a muzzle break of an underwater gun.

It is a further object of the present invention to provide a simple device for diverting exhaust gases before entry into the sabot separation chamber of an underwater gun thereby allowing better separation within the chamber.

In order the attain the objects described above, there is provided a muzzle break generally comprising a baffle plate to deflect the exhaust gas pressure wave while allowing a projectile from an attached gun barrel to continue past the baffle into a sabot separation chamber; a series of exhaust slots in the muzzle break that allows exhaust gases of the deflected exhaust gas pressure wave to be released; a membrane sleeve to seal the exhaust slots and a separate membrane to seal the separation chamber at a projectile exit of the underwater gun.

An option for the muzzle break would be a connection to pressure equalization chambers in which the pressure of the interior of the muzzle break could be equalized with an exterior underwater pressure. The pressure equalization chambers are tubes that open at the bottom or a point in contact with water in which the gun is submerged. As the gun is submerged, water enters the equalization chambers at the bottom to compress any air or gas in the chamber with the air or gas transmitted as compressed air or gas in the muzzle break. The water level rises within the equalization chambers to a point where the internal pressure in the gun is equal to the external depth pressure of the water. As the submergence depth of the gun is changed, the pressure in the gun and separations chamber is passively adjusted to the external water pressure. This adjustment in pressure maintains the difference in pressure across the sealing membranes to a point at or near zero, thereby minimizing the force on the membranes prior to firing the gun. The internal volume of the pressure equalization chambers must be greater than the internal volume of the gun and muzzle break.

During firing of the underwater gun, the exhaust gas created by an ignited propellant charge exits the barrel and impacts the baffle plate. The baffle plate restricts the gas flow and deflects the gas pressure wave to impact the sides of the muzzle break. As such, the generated pressure wave is sufficient to expand and burst the membrane-sleeve that seals the slots. If the cross-sectional area of exhaust slots is greater than the cross-sectional area of the opening in the baffle plate more gas is exhausted through the slots than the amount that would exhaust through the opening of the baffle.

Continuing the firing, the round passes through the opening in the baffle plate with a small portion of the exhaust gas traveling through the opening and into the sabot separation chamber. The gas pressure in the sabot separation chamber is greatly reduced relative to the pressure that impacts the baffle plate. As the round (sabot and projectile) travels through the sabot separation chamber, the volume and velocity of the exhaust gas is greatly reduced. This reduction in volume and velocity of the exhaust gas allows the sabot petals to separate from the projectile quickly. The projectile continues on to penetrate the membrane seal on the end of the muzzle break and enters the water separated from the sabot petals. An apparent advantage of the present muzzle break is that volume and pressure exhaust gas is simply and greatly reduced before the separation chamber, which allows more efficient separation of the sabot petals.

As indicated above, the optional passive pressure equalization system may be configured with the muzzle break. Alternatively, the muzzle break may be configured with an actively controlled pressure equalization system comprising a pressurized gas cylinder, a pressure sensor, a pressure regulation valve, a pressure relief valve and a controller. The pressure sensor measures the ambient pressure outside the gun and signals the pressure controller. As the gun is lowered into the water the pressure sensor measures the change in depth pressure. The controller responds to the pressure sensor by adjusting the pressure regulation valve to let gas flow from the gas tank to flow into the gun and muzzle break. If the gun was raised to a shallow depth, the pressure controller lowers the pressure in the gun and muzzle break by opening the pressure relief valve.

BRIEF DESCRIPTION OF THE DRAWINGS

The foregoing objects and other advantages of the present invention will be more fully understood from the following detailed description and reference to the appended drawings is wherein.

DESCRIPTION OF THE PREFERRED EMBODIMENTS

Figure 1:
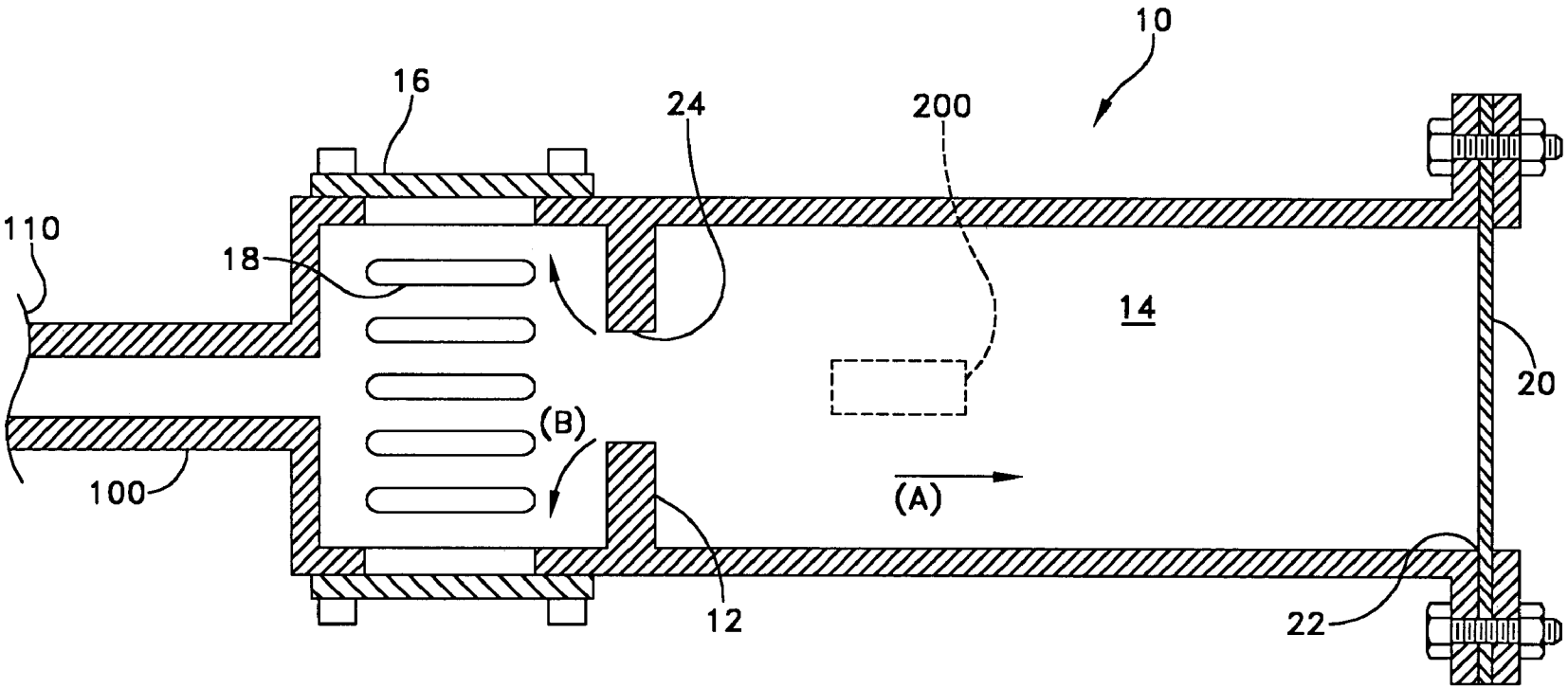
FIG. 1 is a cross-sectional view of a muzzle break of the present invention.

Referring now to the drawings wherein like numerals refer to like elements throughout the several views, one sees that FIG. 1 depicts a muzzle break 10 of the present invention. The muzzle break 10 mountable as part of an underwater gun 100 (partially shown) generally comprises a baffle plate 12, a sabot separation chamber 14, a membrane sleeve 16 affixed by bolting 17 and sealed to the muzzle break, exhaust apertures formed as slots 18 and an exit membrane 20 affixed by a flange 21 an underwater gun exit 22. The membrane for the membrane sleeve 16 and the exit membrane 20 are made of rubber or any sealing material known in the art that would seal the indicated areas of the muzzle break 10 yet be easily separable from the muzzle break.

In the pre-firing state of the underwater gun 100, the muzzle break 10 is sealed by the membrane sleeve 16 over the exhaust slots 18 and the exit membrane 20 over the underwater gun exit 22. During firing of a projectile 200 in direction "A", the exhaust gas exits a barrel 110 of the underwater gun 100 and impacts the baffle plate 12. The baffle plate 12 restricts the exhaust gas flow and deflects the exhaust gas pressure wave. The deflected pressure wave (indicated by direction arrow "B") impacts the sides of the muzzle break 10. The deflected pressure wave is sufficient to expand and burst the membrane sleeve 16 that seals the exhaust slots 18.

The cross sectional area of the exhaust slots 18 is greater than the cross sectional area of an opening 24 in the baffle plate 14. Since the cross-sectional area of exhaust slots 18 is greater than the cross-sectional area of the opening 24 in the baffle plate more gas is exhausted through the slots than the amount that would exhaust through the opening of the baffle.

The fired projectile 200 continues through the opening 24 with only a small portion of the exhaust gas traveling in direction "A" through the opening into the sabot separation chamber 14. The gas pressure in the sabot separation chamber 14 is greatly reduced relative to the pressure that impacts the baffle plate 12. As the projectile 200 (sabot and round) travels through the sabot separation chamber 14, the volume and velocity of the exhaust gas is also greatly reduced. This reduction allows the sabot petals of the projectile 200 to separate quickly. The projectile 200 continues in direction "A" to penetrate the exit membrane seal 20 and enter the water separated from the sabot petals.

Figure 2:
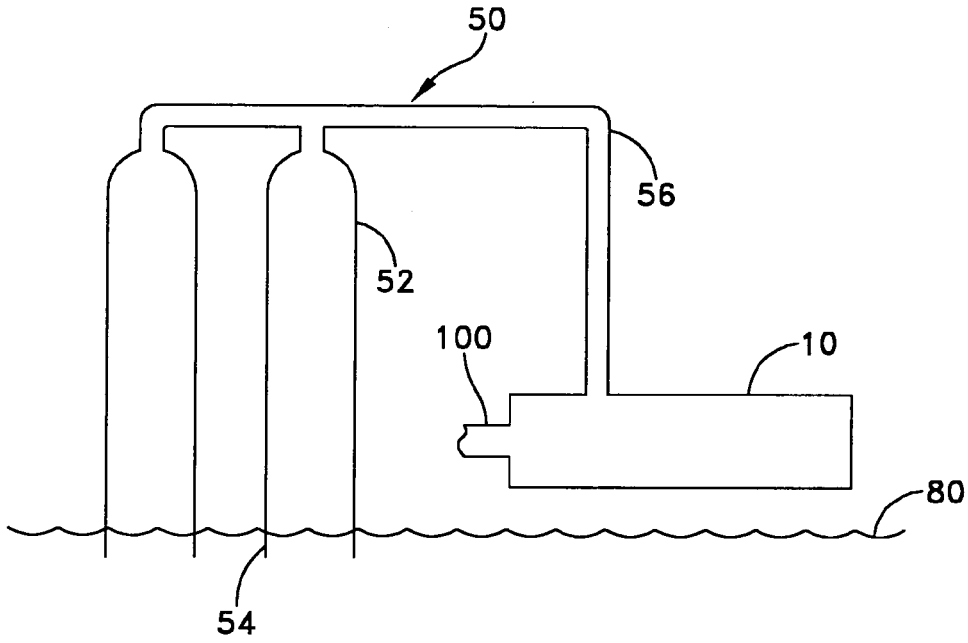
FIG. 2 is a diagram of a passive pressure equalization system for the muzzle break of the present invention with the system positioned prior to submergence.

The muzzle break 10 as part of the underwater gun 100 may further comprise either a passive pressure equalization system 50 or active pressure equalization system 60. As shown in FIG. 2 with the muzzle break 10 above a water surface 80, the passive pressure equalization system 50 includes tubes 52 which open at a bottom 54 with the bottom beneath a level that the muzzle break would be on. The tubes 52 are fluidly attached to the underwater gun 100 via a connecting hose 56.

Figure 3:
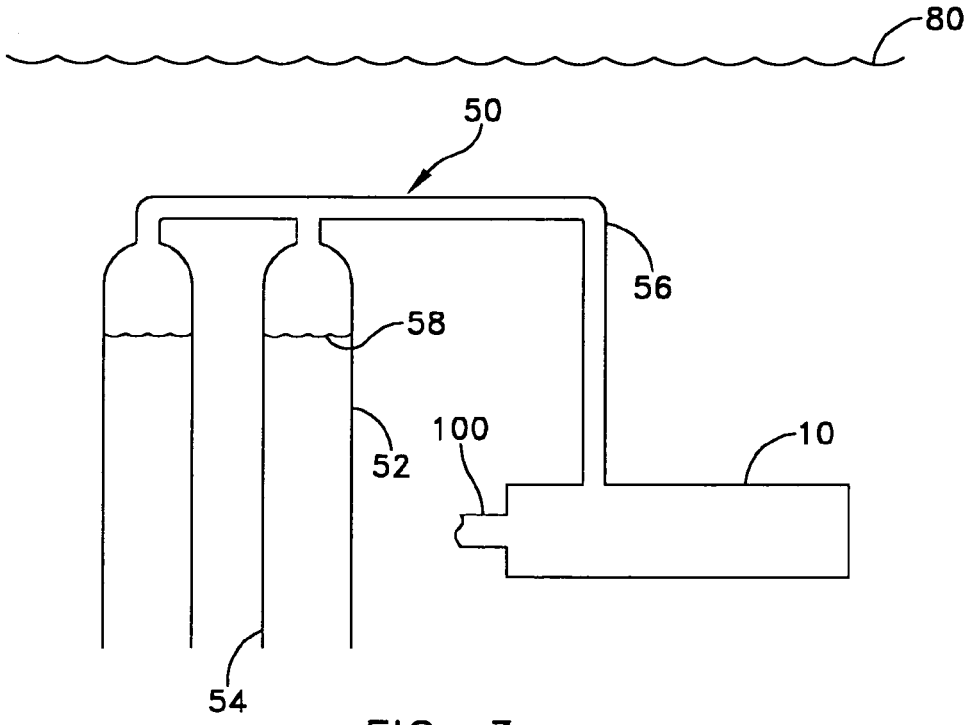
FIG. 3 is a diagram of the passive pressure equalization of FIG. 2 with the system submerged.

As the underwater gun 100 is submerged to a level shown in FIG. 3, water enters the tubes 52 and compresses any gas in the underwater gun 100 and the muzzle break 10 via the connecting hose 56. While submerging, a level of water 58 in the tubes 52 rises to a point where internal pressure in the underwater gun 100 and the muzzle break 10 is equal to an ambient depth pressure external to the underwater gun. As such, the submergence depth changes the pressure in the underwater gun 100 and the muzzle break 10 to passively adjust to the external water pressure. This adjustment maintains a pressure difference across the sealing membranes 16 and 20 at or near zero and thus minimizes external forces on the membranes prior to firing the underwater gun 100. To prevent any water from entering the muzzle break 10, the internal volume of the pressure equalization system 50 must be greater that the internal volume of the underwater gun 100 and the muzzle break.

Figure 4:
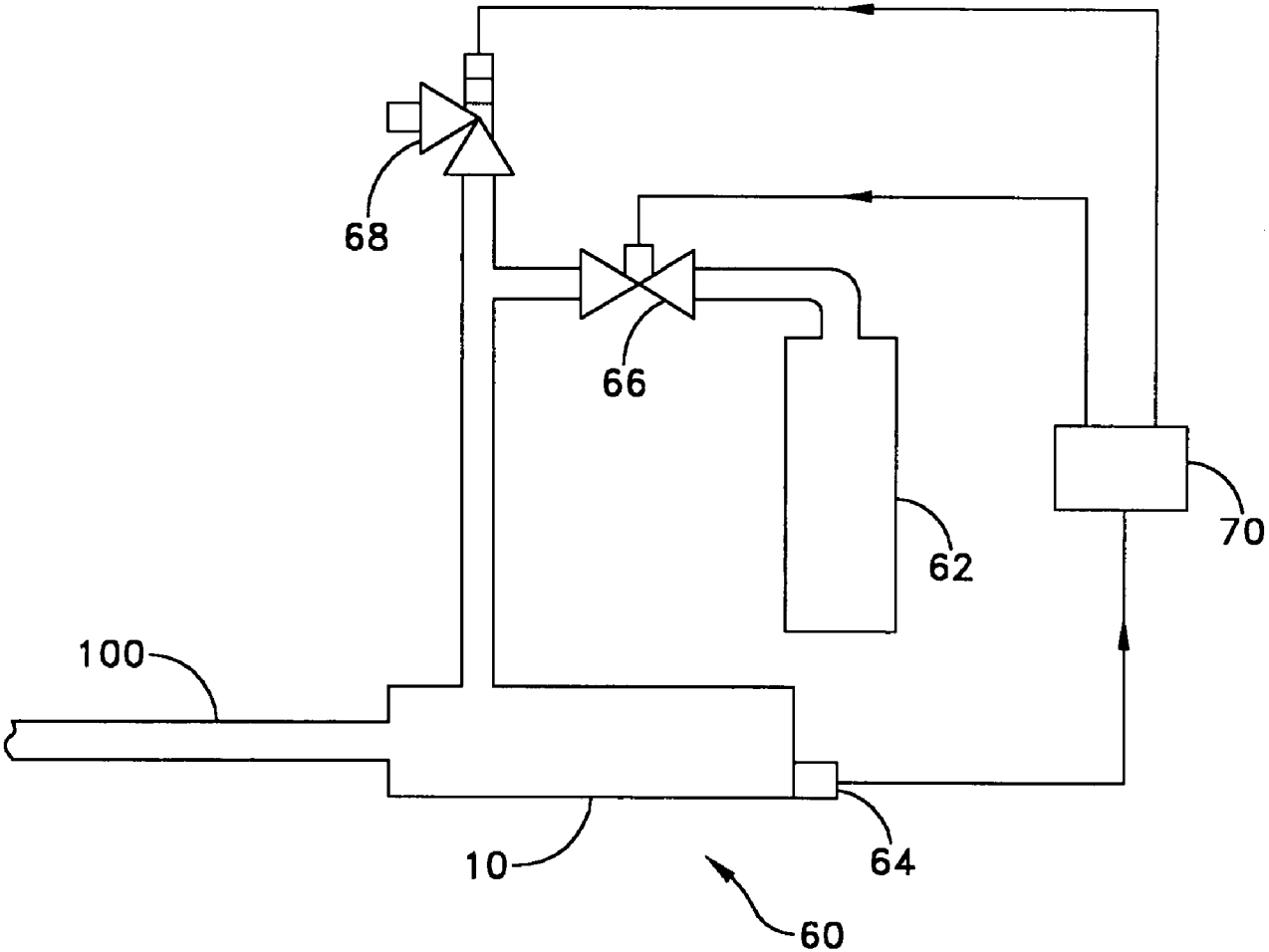
FIG. 4 is a diagram of an active pressure equalization system for the muzzle break of the present invention.

The passive pressure equalization system 50 is optional and the invention may be configured with or without this sub-system. Alternatively, the pressure equalization system may be actively controlled. The active pressure equalization system 60 of FIG. 4 generally comprises a pressurized gas cylinder 62, a pressure sensor 64, a pressure regulation valve 66, a pressure relief valve 68 and a controller 70.

In operation, the pressure sensor 64 measures the local ambient pressure outside the underwater gun 100 and signals the controller 70. As the underwater gun 100 is lowered into the water, the pressure sensor 64 measures the change in local ambient pressure resulting from a change in depth. The controller 70 responds to a signal from the sensor 64 by adjusting the pressure regulation valve 66 to release gas from the pressurized gas cylinder 62 to flow into the underwater gun 100 and the muzzle break 10. If the underwater gun 100 is raised to a shallower depth, the controller 70 lowers the pressure in the gun and the muzzle break by opening the pressure relief valve 68.

Thus by the present invention its objects and advantages are realized and although preferred embodiments have been disclosed and described in detail herein, its scope should be determined by that of the appended claims.

What is claimed is:

1. A muzzle break for a gun having a propellant charge and a projectile with sabot, said muzzle break comprising:

a housing defining a projectile path and a sabot separation chamber, said housing including a first end mountable to a barrel of the gun and encompassing a projectile inlet port in said housing with said housing further including a second end encompassing a projectile outlet port in said housing for an egress of said sabot separation chamber, said housing having at least one aperture formed therein adjacent to said first end;

a first membrane affixed to an exterior of said housing and positioned to seal said at least one aperture;

a second membrane affixed to an exterior of said housing and positioned to seal said projectile outlet port, said second membrane separable from said projectile outlet port when in contact with the projectile fired from the gun; and a baffle disposed within the projectile path defined by said housing and being capable of deflecting gases produced by an ignited propellant charge during the firing of the gun; and wherein said first membrane is capable of separating from said housing by the gases exiting through said at least one aperture thereby reducing a volume of the gases within said sabot separation chamber.

2. The muzzle break in accordance with claim 1 wherein a cross-sectional area of said at least one aperture is greater than a cross-sectional area for an opening defined by said baffle within the projectile path thereby allowing a greater amount of the gases produced by the ignited propellant charge to exhaust through said at least one aperture than through said opening.

3. A muzzle break for a gun having a propellant charge and a projectile with sabot, said muzzle break comprising:

a housing defining a projectile path and a sabot separation chamber, said housing including a first end mountable to a barrel of the gun and encompassing a projectile inlet port in said housing with said housing further including a second end encompassing a projectile outlet port in said housing for an egress to said sabot separation chamber, said housing having at least one aperture formed therein adjacent to said first end;

a first membrane affixed to an exterior of said housing and positioned to seal said at least one aperture;

a second membrane affixed to an exterior of said housing and positioned to seal said projectile outlet port, said second membrane separable from said projectile outlet port when in contact with the projectile fired from the gun;

a supply of pressurized gas fluidly connected to said housing and capable of providing said housing with a pressure equal to a pressure exterior to said housing; and a baffle disposed within the projectile path defined by said housing and being capable of deflecting exhaust gases produced by an ignited propellant charge during the firing of the gun; and wherein said first membrane is capable of separating from said housing by the gases exiting through said at least one aperture thereby reducing a volume of the gases within said sabot separation chamber.

4. The muzzle break in accordance with claim 3 wherein a cross-sectional area of said at least one aperture is greater than a cross-sectional area for an opening defined by said baffle within the projectile path thereby allowing a greater amount of the gases produced by the ignited propellant charge to exhaust through said at least one aperture than through said opening.

5. The muzzle break in accordance with claim 3 wherein said supply of pressurized air comprises at least one open-ended container with a volume greater than that of said housing, said supply of pressurized air fluidly connected to said housing whereupon an impact with a source of fluid compresses a volume of air within said container to transmit the pressure of the air to said housing.

6. The muzzle break in accordance with claim 4 wherein said supply of pressurized air comprises at least one pressurized cylinder fluidly connected to said housing with a first valve there-between with said first valve controllable in response to a sensor whereupon a signal by said sensor controls a release of said supply of pressurized air to said housing by opening said first valve for equalizing the pressure within said housing to the pressure exterior to said housing.

7. The muzzle break in accordance with claim 6 wherein said supply of pressurized air further comprises a second valve fluidly connected between said first valve and said housing with said second valve controllable in response to said sensor whereupon a signal by said sensor controls a release of said supply of pressurized air to a volume exterior to said supply of pressurized air and said housing for equalizing the pressure within said housing to the pressure exterior to said housing.

* * * * *